United States Patent [19]

Hurt

[11] 4,221,161

[45] Sep. 9, 1980

[54] METHOD OF FORMING A DOUBLE POCKET ENVELOPE

[75] Inventor: Hampton L. Hurt, Tulsa, Okla.

[73] Assignee: Frank D. Stroud, Tulsa, Okla. ; a part interest

[21] Appl. No.: 921,892

[22] Filed: Jul. 5, 1978

[51] Int. Cl.[3] ..... B65D 27/08

[52] U.S. Cl. ..... 93/1 R; 229/72; 93/35 PC

[58] Field of Search ..... 93/35 PC, 52, 58.5, 93/62, 84 R, 1 R; 229/72

[56] References Cited

U.S. PATENT DOCUMENTS

| | | | |
|---|---|---|---|
| 3,025,767 | 3/1962 | Ruffalo | 93/1 R |
| 3,129,872 | 4/1964 | Lutwack | 229/72 |
| 3,460,774 | 8/1969 | Turkenkopf | 229/72 X |
| 3,979,051 | 9/1976 | Close | 229/72 |

*Primary Examiner*—Robert D. Baldwin
*Attorney, Agent, or Firm*—Head & Johnson

[57] ABSTRACT

A method of forming a double pocket envelope from a single sheet including the steps of cutting the single sheet to provide a base portion, a partition flap, and a front flap, and opposed end flaps; folding the partition flap against the base and folding the front flap against the partition flap, followed by folding the end flaps over the folded front and partition flaps; and cementing the end flaps. Next, the folded edge of the base portion and partition flaps are cut to provide a primary envelope between the base portion and the partition flap and a secondary envelope between the partition flap and front flap.

2 Claims, 7 Drawing Figures

METHOD OF FORMING A DOUBLE POCKET ENVELOPE

BACKGROUND AND OBJECTS OF THE INVENTION

Envelopes are usually of a single container type; that is, having a front and back with bonded side and bottom edges, but there are some applications in which it is desirable to have a double pocket envelope. As an example, hospitals prefer to use double double pocket envelopes for maintaining the X-rays and records of a patient. Typically, the X-rays are kept in one pocket of the envelope and the patient's records in the other. In this way, the X-rays and records are maintained together in one envelope but are separated so as not to interfere with each other.

Several companies manufacture double pocket envelopes. A typical arrangement includes manufacturing an envelope of the standard design and cutting a slot in the front. A divider is cemented to the rear surface of the front portion above the slot to provide a divided envelope forming the required two compartments. While this procedure is satisfactory in providing a multi-compartment envelope, it is rather time consuming and expensive in that it requires two completely separate sheets of paper which have to be handled for orientation and cementing.

The present invention is directed toward a method of manufacturing a double pocket envelope utilizing a single sheet of paper. The method is advantageous in that it is less time consuming and, therefore, more economical to manufacture. In addition, since the envelopes are manufactured from single sheets of paper, the apparatus necessary to manufacture the envelope is easier to construct, and uniformity is achieved since there is no requirement of accurately aligning separate sheets of paper for cementing operations.

It is therefore an object of this invention to provide a double compartment envelope and, particularly, a method of manufacturing the envelope utilizing a single sheet of paper.

Still more particularly, an object of this invention is to provide a method of forming a double pocket envelope utilizing a single sheet of paper including the steps of folding, cementing, and cutting the paper in such a way that the entire double pocket envelope is formed of a single sheet of paper.

These general objects as well as other and more specific objects of the invention will be fulfilled in the following description and claims, taken in conjunction with the attached drawings.

DESCRIPTION OF VIEWS

SUMMARY OF THE INVENTION

The method of forming a double pocket envelope from a single sheet of paper which comprises the steps of first cutting a flat sheet of paper to an outline having a rectangular base portion, a partition flap, a front flap, and opposed end flaps, the partition flap and front flap being on opposite sides of the base portion and of a length less than the height of the base portion, folding the partition flap against the base portion, folding the front flap against the partition portion so that the two flaps overlap each other, folding the end flaps over the overlapped front flap and exposed portion of the partition flap, and cementing the end flaps to the front flap and the exposed portion of the partition flap and cutting the full length of the partition flap and base portion at the folded juncture thereof which provides a first envelope area between the base portion and the partition flap and a second envelope area between the partition flap and the front flap.

DETAILED DESCRIPTION

Figure 1:
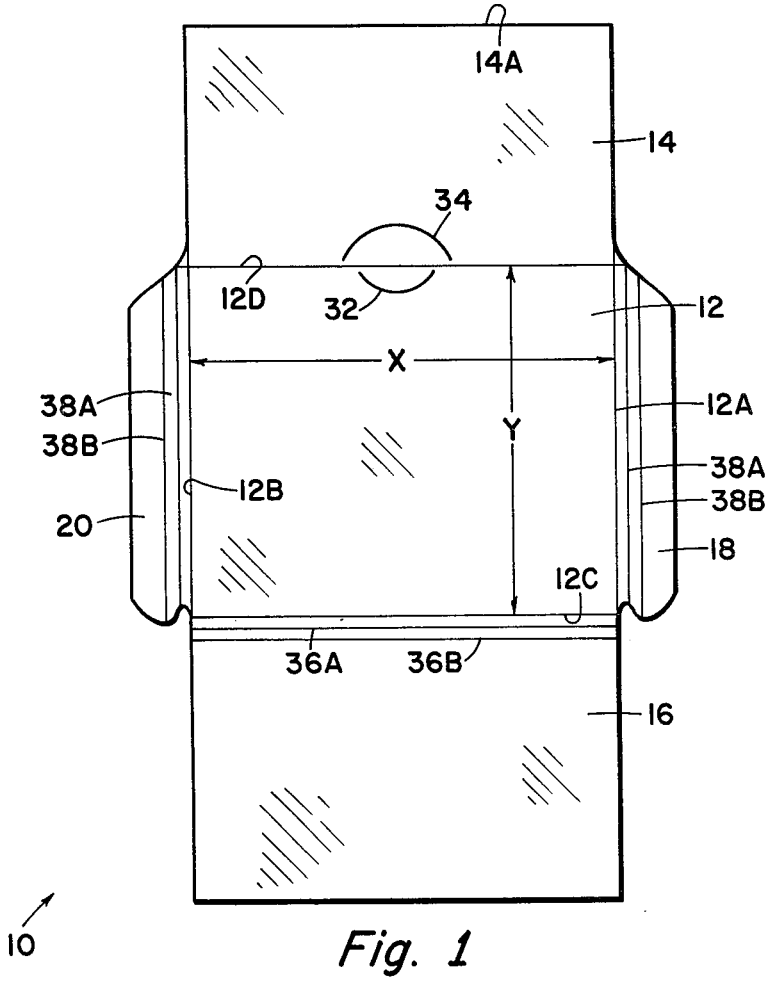
FIG. 1 is a plan view of a flat sheet of paper which has been cut in the shape necessary to form a double pocket envelope by the method of this invention.

Referring to the drawings and first to FIG. 1, the first step in manufacturing a double pocket envelope according to this invention is to cut a single sheet of paper more or less in the form outlined in FIG. 1, the sheet of cut paper being generally indicated by the numeral 10. The sheet of paper 10 includes a rectangular base portion 12 having a length X between opposed ends 12A and 12B, and a height Y between bottom side 12C and the top side 12D. A partition flap 14 integrally extends from the base portion top side 12D. The length of the partition flap 14 is X, that is, substantially the same as that of the base portion 12, and the height is less than Y.

Integrally extending from the bottom side 12C of base portion 12 is a front flap 16 which has a length X and a height less than Y.

Integrally extending from base portion 12 at end 12A is a first end flap 18. The end flap 18 is of short width and of length not greater than Y. The second end flap 20 integrally extends from base portion end 12B and is of the same dimension as first end flap 18.

The sheet 10 illustrated in FIG. 1 has additional cuts and accordian fold lines which will be described subsequently, the elements being described to this point being the essential ones for forming a double pocket envelope according to the invention.

Figure 2:
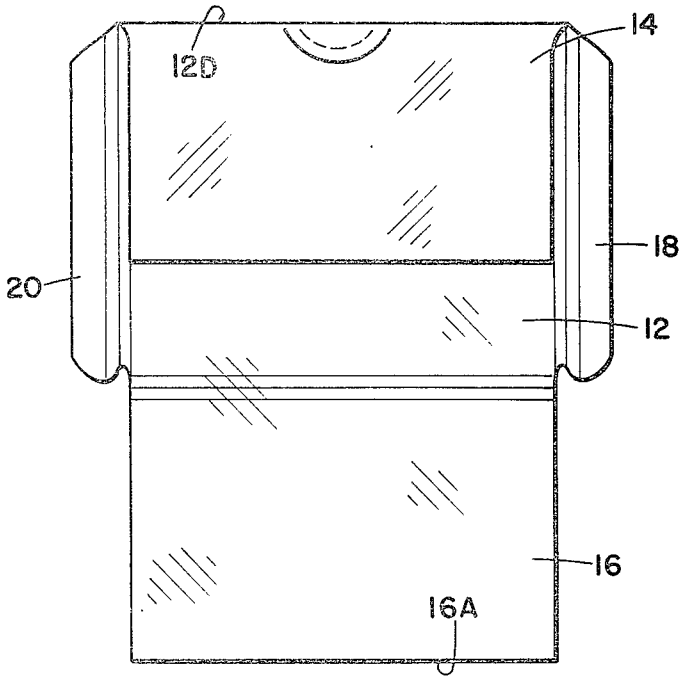
FIG. 2 shows the first step of folding of the sheet as cut in FIG. 1.

After cutting the sheet of paper to the outline as shown in FIG. 1, the next step in forming the envelope is shown in FIG. 2 in which the partition flap is folded parallel to and against the base portion 12, the fold being along the base portion edge 12D.

Figure 3:
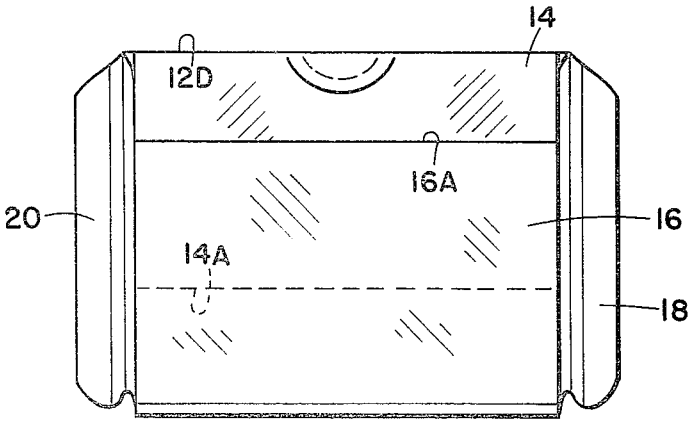
FIG. 3 shows the second step of folding.

The next step is the folding of a front flap 16 over and against the folded partition flap 14 as illustrated in FIG. 3. Since the height of the front flap 16 is less than Y, that is, less than the height of the base portion 12, a portion of partition flap 14 adjacent the juncture with base portion 12D is exposed above the front flap edge 16A.

Figure 4:
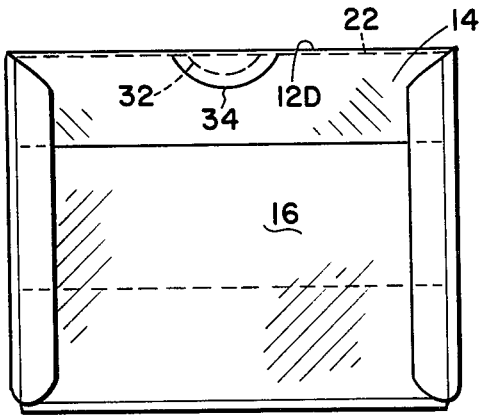
FIG. 4 shows the step of folding of the end flaps and bonding them to the overlapped partition and front flaps of the envelope.

The next step is to fold the end flaps 18 to 20 over the front flap 16 and the exposed portion of partition flap 14, as illustrated in FIG. 4. The next step is cementing the end flaps 18 and 20 to the front flap 16 and exposed portion of partition flap 14. However, this operation may be combined with the folding step if the surfaces of the end flaps contacting the front and partition flaps are provided with adhesive prior to the folding operation. As shown in FIG. 4, the folding operations are completed and a unitary folded envelope is prepared. However, there is no access between the partition flap 14 and the base portion 12. To provide such access, the next step is cutting the full length of the partition flap and the base portion at the folded juncture thereof along and parallel to base portion edge 12D, the cutting being done along the dotted line 22 as indicated in FIG. 4. After the folded and cemented envelope of FIG. 4 has been cut along line 22, the manufacture of the envelope is finished, and it appears as in FIG. 5.

Figure 6:
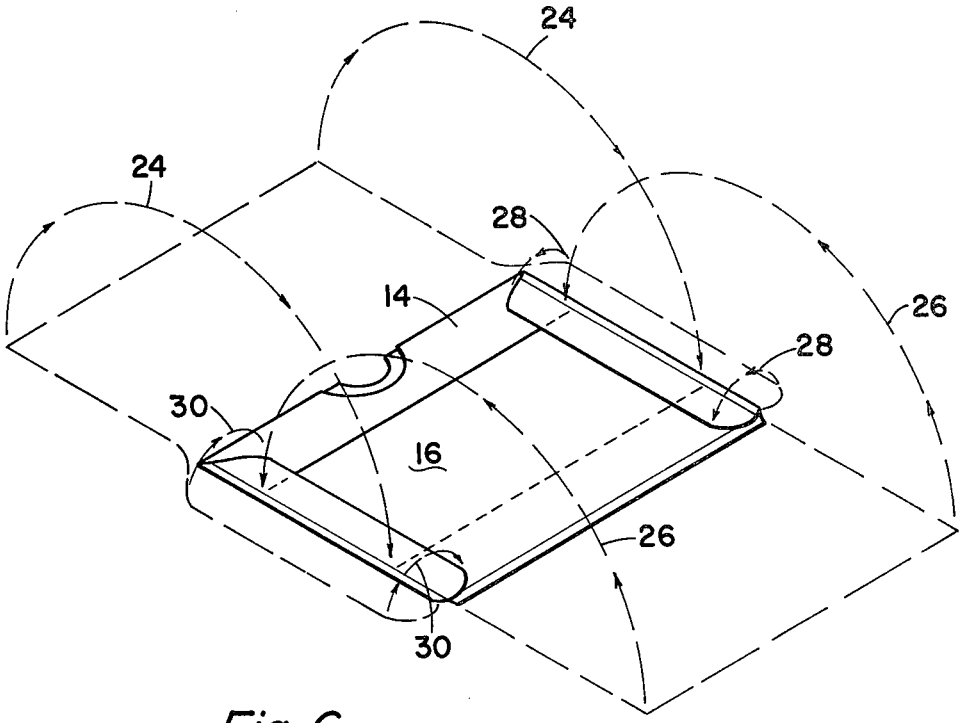
FIG. 6 is a perspective view showing the method of folding the flaps to form the envelope.

FIG. 6 is a perspective view showing the envelope in completed form but showing how the folding is accomplished with the folding of the partition side being indicated by the arrows identified by the numeral 24; the folding of the front flap by arrows 26, and folding of the end flaps by arrows 28 and 30.

FIG. 6 shows the upper edge of the base portion and the partition flaps having been cut as described with reference to FIG. 4.

Figure 5:
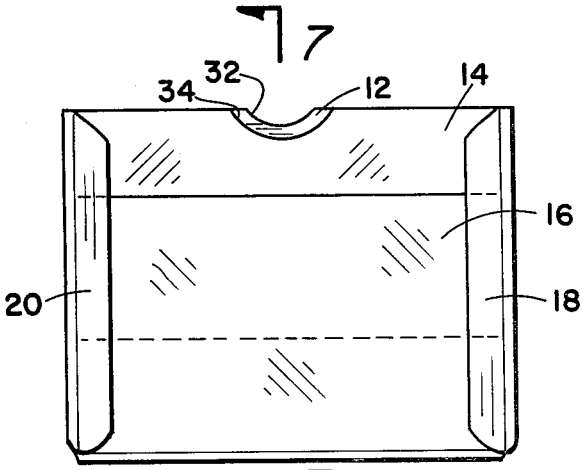
FIG. 5 shows the step of cutting the envelope at the folded juncture of the partition flap and base portion as the final step in forming the envelope.
Figure 7:
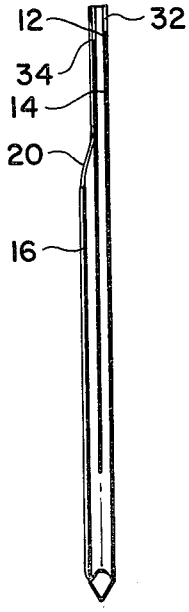
FIG. 7 is a cross-sectional view of the completed envelope as taken along the line 7—7 of FIG. 5.

Referring again to FIG. 1, the base portion of the flat sheet is shown with an arcuate thumb cut 32 which is adjacent side 12D. In addition, a thumb cut 34 of larger arcuate radius is cut in the partition flap 14 adjacent the fold line 12D. After the folding operation described with reference to FIGS. 2, 3, and 4 and the cut along line 22 as shown in FIG. 4, the portions cut out by the thumb cuts 32 and 34 are removed so that the envelope has the appearance of FIG. 5. These thumb cuts make it easier to separate the partition flap 14 and base portion 12 for insertion of material into the first pocket of the envelope. It can be seen that, if desired, only the thumb cut 34 in partition flap 14 may be provided or the configuration and placement of the thumb cuts may be varied. The principle provided in this arrangement, however, allows the thumb cuts 32 and 34 of the envelope as shown in FIG. 5 to be established without additional operation, except providing the cut in the flat sheet of FIG. 1 as a part of the initial step of manufacturing the envelope.

In addition, and again referring to FIG. 1, accordian fold lines 36A and 36B are formed in the front flap 16 parallel to and spaced from base portion side 12C. In like manner, accordian fold lines 38A and 38B are provided in each of the side flaps 18 and 20 parallel to and spaced from base portion ends 12A and 12B respectively. When these fold lines are employed, the envelope, after construction, may be expanded to receive a larger quantity of materials. When fold lines 36A, 36B, 38A, and 38B are employed, the front flap 16 is folded at line 36A against base portion 12, and end flaps 18 and 20 are folded at lines 38A over the partition flap 14 and front flap 16 as in FIG. 4 so that the envelope, after the end flaps are cemented, is free to expand.

The invention described provides a method of manufacturing a double pocket envelope utilizing a single sheet of paper by the steps of folding the paper, cementing the end flaps, and cutting the strip along the top of the folded edge. No other steps are required, and no other supplemental sheets need to be installed to complete the double pocket envelope. The method of the invention allows the envelope to be manufactured in a manner adaptable to machine operation since only a single sheet of paper is handled during the entire operation.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A method of forming a double pocket envelope from a single sheet, comprising the steps of:

(1) cutting a flat sheet to the following outline:

(a) a rectangular base portion having a length X between opposed ends and a height Y between opposed sides, (b) a partition flap integrally extending from one side of the base portion, the partition flap having a length X and a height less than Y, (c) a front flap integrally extending from the other side of the base portion, the front flap having a length X and a height less than Y, (d) an end flap integrally extending from each base portion end, each end flap being of short width and of length not greater than Y;

(e) a thumb notch cut in said partition flap at the juncture with said base portion, and (f) a thumb notch cut in said base portion at the juncture with said partition portion, the thumb notch cuts being out-of-register with each other;

(2) folding said partition flap against said base portion;

(3) folding said front flap against said partition flap whereby said partition flap lies between said base portion and said front flap, and a portion of said partition flap adjacent the juncture with said base portion is exposed;

(4) folding said end flaps over said front flap and the exposed portion of said partition flap;

(5) cementing said end flaps to said front flaps and the exposed portion of said partition flap;

(6) cutting the full length of said partition flap and said base portion at the folded juncture thereof providing a first envelope area between said base portion and said partition flap and a second envelope area between said partition flap and said front flap; and (7) removing the portions defined by the thumb notch cuts thereby providing notches which make it easier to separate the partition flap and base portion.

2. The method according to claim 1 wherein step (1) of cutting a flat sheet includes the steps of (g) forming at least one accordian fold line in said front flap adjacent to, spaced from, and parallel with the juncture with said base portion, and (h) forming at least one accordian fold line in each of said end flaps adjacent to, spaced from, and parallel with the juncture with said base portion, whereby when the envelope is completed the interior thickness may be expanded to receive thicker contents.

* * * * *